US007953348B2

(12) United States Patent
Chang et al.

(10) Patent No.: US 7,953,348 B2
(45) Date of Patent: May 31, 2011

(54) FUSING DEVICE AND IMAGE FORMING APPARATUS HAVING THE SAME

(75) Inventors: Woong-jae Chang, Seongnam-si (KR); Sea-chul Bae, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 817 days.

(21) Appl. No.: 11/736,194

(22) Filed: Apr. 17, 2007

(65) Prior Publication Data

US 2008/0069589 A1 Mar. 20, 2008

(30) Foreign Application Priority Data

Sep. 15, 2006 (KR) ..... 10-2006-0089822

(51) Int. Cl.
*G03G 15/08* (2006.01)

(52) U.S. Cl. ..... 399/122; 399/328; 347/104

(58) Field of Classification Search ..... 399/7, 33, 399/122, 320, 328
See application file for complete search history.

(56) References Cited

U.S. PATENT DOCUMENTS

| | | | | |
|---|---|---|---|---|
| 4,428,660 | A | 1/1984 | Matsumoto | |
| 2003/0118382 | A1 * | 6/2003 | Tomatsu | 399/328 |
| 2007/0008395 | A1 * | 1/2007 | Masubuchi et al. | 347/104 |
| 2007/0077104 | A1 * | 4/2007 | Hasegawa | 399/328 |

FOREIGN PATENT DOCUMENTS

| | | |
|---|---|---|
| EP | 1 584 779 | 10/2005 |
| EP | 1 612 619 | 1/2006 |
| JP | 7-295429 | 11/1995 |
| JP | 2001-134162 | 5/2001 |

OTHER PUBLICATIONS

Search Report issued on Jan. 16, 2008 by the European Patent Office for European Patent Application No. 07111304.7-2209.

* cited by examiner

*Primary Examiner* — David M Gray
*Assistant Examiner* — Roy Yi
(74) *Attorney, Agent, or Firm* — Staas & Halsey LLP

(57) ABSTRACT

A fusing device of an image forming apparatus which applies principles of leverage, and an image forming apparatus containing such a device. The fusing device includes a fusing unit having a heating roller and a pressure roller facing each other and which rotate together, a cover which opens and closes the fusing unit, and a pressure and release unit, one end of which is rotatably fixed to a rotating shaft, the pressure and release unit containing a member having a pressuring unit which pressures the pressure roller towards the heating roller when the cover opens and shuts, and a pressured part, which is farther from the rotating shaft than the pressuring part and which receives pressure from the cover.

18 Claims, 3 Drawing Sheets

FUSING DEVICE AND IMAGE FORMING APPARATUS HAVING THE SAME

CROSS-REFERENCE TO RELATED APPLICATION

This application claims the priority of Korean Patent Application No. 2006-89822 filed on Sep. 15, 2006, in the Korean Intellectual Property Office, the disclosure of which is incorporated herein by reference.

BACKGROUND OF THE INVENTION

1. Field of the Invention

Aspects of the present invention relate to a fusing device of an image forming apparatus, and more specifically, to a device which releases the pressure between rollers used in fusing an electrostatic latent image onto print material.

2. Description of the Related Art

Image forming apparatuses generally include a paper feed device which picks up paper from a feeding tray and feeds the paper along a feed path, a developing device which applies developing materials to an electrostatic latent image and develops the image, a transfer device which transfers the developed image onto the paper, and a fusing device which fuses the developed image onto a surface of the paper using heat and pressure.

FIG. 1 is a conceptual diagram explaining how a fixing roller in a related art fusing device is pressured and released. As shown in FIG. 1, a related art fusing device 1 includes a heating roller 2 which heats the paper, a pressure roller 3 which provides pressure when in contact with the heating roller 2, a pressure spring 4 which presses the rotational axis 3' of the pressure roller 3 towards the heating roller 2 and maintains pressure on the pressure roller 3, and a pressure release member 6 disposed on the side of the rotational axis 3' opposite the pressure spring 4 which releases pressure by pushing the rotational axis 3' of the pressure roller 3 in the direction of the pressure spring 4 according to the rotation of a cam 5.

In such a configuration, the pressure supplied by the pressure roller 3 is maintained or released according to a rotation of the cam 5. That is, in order to release the pressure, the installed cam 5 rotates according to the method described above, and the pressure release member 6 releases the pressure by pushing the pressure roller 3 away from the heating roller 2 while rotating around a hinge 6' towards the pressure spring 4. If the cam 5 rotates in the opposite direction, pressure is added to the pressure roller 3 using the pressure spring 4.

When the cover of the image forming apparatus is opened for purposes of maintenance or the like, for example, when paper is jammed between the heating roller 2 and the pressure roller 3 during image formation, or when the cover is closed in order to operate the image forming apparatus, the pressure roller 3 should be pressured or released, and so the opening and closing of the cover and the rotation of the cam should occur together.

In a related art fusing device, various mechanisms have been suggested in order to achieve this joint opening and closing. One suggested method uses a position detection sensor on the cam, and a power source which moves the cam so the position of the cam can be adjusted according to the opening and closing of the cover.

However, if a separate power source and position detection sensor are used as described above, these added components increase costs, and if the system suddenly halts during operation (for example, due to power being cut or a lightning strike), the reliability of the high pressure release function also drops, or additional costs are required to maintain reliability.

A second suggested method adjusts the angle of the cam according to whether the cover is open or shut by installing a lever attached to one side of the cover and connecting the other side of the cover to part of the cam. However, a problem with this second suggested method is that the reliability of the high pressure release function may drop if the configuration changes due to changes in the lever or cam caused by the high temperature of the heating roller or wear and tear of the cam parts.

An aspect of the present invention provides a fusing device in an image forming apparatus which resolves at least the above and/or other problems, reduces pressure in the fusing apparatus through the cover of the image forming apparatus being opened with minimal effort by the user, and increases pressure supplied by the pressure roller in a stable fashion when the cover is closed.

Another aspect of the present invention is to provide an image forming apparatus comprising the aforementioned fusing device.

SUMMARY OF THE INVENTION

According to an aspect of the invention, a fusing device of an image forming apparatus designed in order to achieve the above and/or other aspects and advantages includes a fusing unit having a heating roller and a pressure roller which contact with other and rotate together, a cover which opens and closes the fusing unit, and a pressure and release unit, including a rotational shaft, and a member rotatable about the rotational shaft and having a pressuring part that transmits pressure to the pressure roller in a direction of the heating roller if the cover is shut and a pressured part pressured by the cover and disposed farther than the pressuring part from the rotational shaft.

According to an aspect, the cover includes a pressure boss to transmit the pressure to the pressured part.

According to an aspect, the pressure and release unit further includes a second rotational shaft, and a second member rotatable about the rotational shaft and having a second pressure boss pressured by the pressuring part, and a second pressuring part that is closer than the second pressure boss to the second rotational shaft and transmits pressure to the pressure roller.

According to an aspect, the second pressure boss is attached to the second pressuring part.

According to an aspect, a second spring inside of the second pressure boss should be stiffer than a spring inside of the first pressure boss.

According to an aspect, the second pressuring part is a side of a recess in which a rotational shaft of the pressure roller is rotatably inserted and which presses the pressure roller in a direction of the heating roller when the cover is closed.

According to an aspect, the second pressuring part includes a stopper to limit a rotation of the member to a predetermined internal range.

According to another aspect of the present invention, an image forming apparatus includes a document feed device which picks up a document from a feeding tray and feeds the document along a feed path, a developing device which applies developing materials to an electrostatic latent image to develop the electrostatic latent image, a transfer device which transfers the developing materials onto the document, and the pressure and release unit described above, which fuses the developing materials onto the document.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
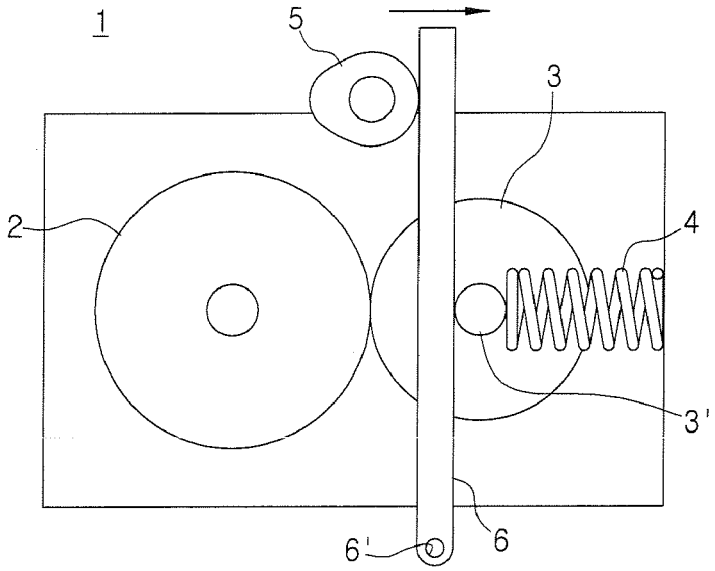
FIG. 1 (PRIOR ART)
FIG. 1 conceptually shows the pressure and release of a fusing roller in a related art fusing apparatus.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
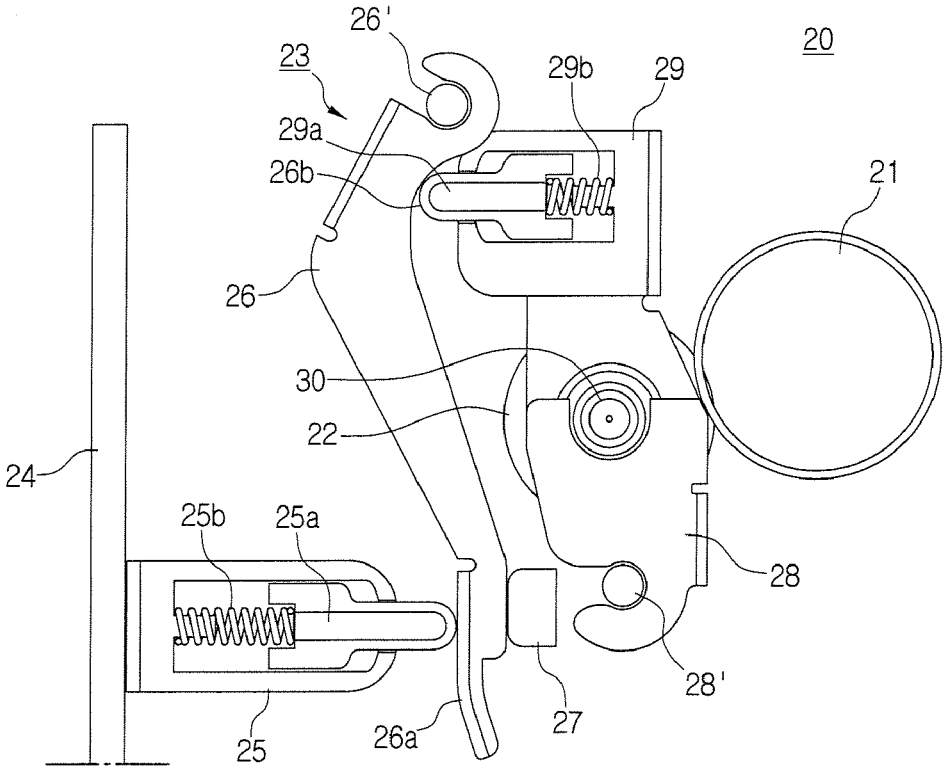
FIG. 2 shows an embodiment of the fusing device according to an embodiment of the present invention.

FIG. 2 shows an embodiment of the fusing device according to an embodiment of the present invention. The fusing device 20 of FIG. 2 includes a heating roller 21 which provides heat, and which a recording medium having a developed image passes by; a pressure roller 22, which faces the heating roller and provides pressure; and a pressure and release unit 23, also known as a lever unit, which provides pressure to and releases the pressure from the above pressure roller 21. It is understood that the recording medium may be various types of recording media, such as paper, transparency sheets, etc.

The pressure and release unit 23 is formed as a two-level lever. As is illustrated in FIG. 2, a first pressure boss 25 is disposed on the inside of a cover 24. A first sliding component 25*a* is supported by a spring 25*b* inside the first pressure boss 25. The first pressure boss 25 contacts and transmits pressure to the first pressured part 26*a* formed on the end of a first member 26, which rotates around a first rotating shaft 26'. It is understood that the first rotating shaft 26' may instead be a hinge or any other component which rotates around a rotational axis.

The first member 26, also known as a first lever, includes a first pressuring part 26*b* disposed closer than the first pressured part 26*a* to the first rotating shaft 26', and transmits the pressure received from the first pressured part 26*a* to the first pressuring part 26*b*, which is amplified according to the principle of leverage.

On the other side of the first pressured part 26*a* of the first member 26, a stopper 27 is installed so that when the cover 24 is closed, an area of movement of the first member 26 is restricted and the amount of pressure transmitted to the first pressured part 26*a* does not exceed a certain limit.

The second member 28, also known as a second lever, includes a second rotating shaft 28', a second pressure boss 29 (also referred to as a second pressured part), and a channel 30 (also referred to as the second pressuring part) which transmits pressure to the pressure roller 22 through the rotating axis of the pressure roller 22, re-transmitting pressure which is again amplified by the principle of leverage. As shown in FIG. 2, the second pressuring part 30 is preferably a side of a recess in which a rotational shaft of the pressure roller 22 is rotatably inserted and which presses the pressure roller 22 towards the heating roller 21 when the cover 24 is closed. However, it is understood that the second pressuring part 30 is not limited to being a side of a recess, and instead may be various other components to engage a roller, such as a hollow protrusion. It is further understood that the second rotating shaft 28' may instead be a hinge or any other component which rotates around a rotational axis.

As the second pressure boss 29, which is the second pressured part, receives the amplified power according to the construction described above, it is desirable that the strength, that is, the stiffness, of the spring 29*b* built into the second pressure boss 29 is greater than the strength of the spring 25*b* built into the first pressure boss 25. A second sliding component 29*b* is supported by the spring 29*b*. Moreover, since the springs 25*b* and 29*b* of the first and second pressure bosses 25 and 29, respectively, are able to conserve a fixed amount of energy, even if energy exceeding the minimum energy levels which the springs 25*b* and 29*b* need to press the pressure roller 22 into the heating roller 21 is transmitted to the pressure roller 22, pressure builds up in the springs 25*b* and 29*b*, and pressure can be released from the pressure roller 22 by opening the cover 24, or the cover 24 can be prevented from opening to maintain the energy levels.

The ratio between the length from the first rotational shaft 26' to the first pressuring part 26*b* and the length from the first rotational shaft 26' to the first pressured part 26*a* is preferably, but not necessarily, about 11:73.5. Moreover, the ratio between the length from the second rotational shaft 28' to the second pressuring part 30 and the length from the second rotational shaft 28' to the second pressured boss 29 which is the second pressured part is preferably, but not necessarily, about 23:55. Using these preferred ratios, in order to press the pressure roller with a force of, for example, 10 kgf, the size of the force to be applied to the cover decreases to 10*23/55*11/73.5=0.626 kgf=626 gf, so the force which should be applied to the cover is reduced by about 16 times. It is understood that other ratios may also be used to configure the structure of the fusing device.

Figure 3:
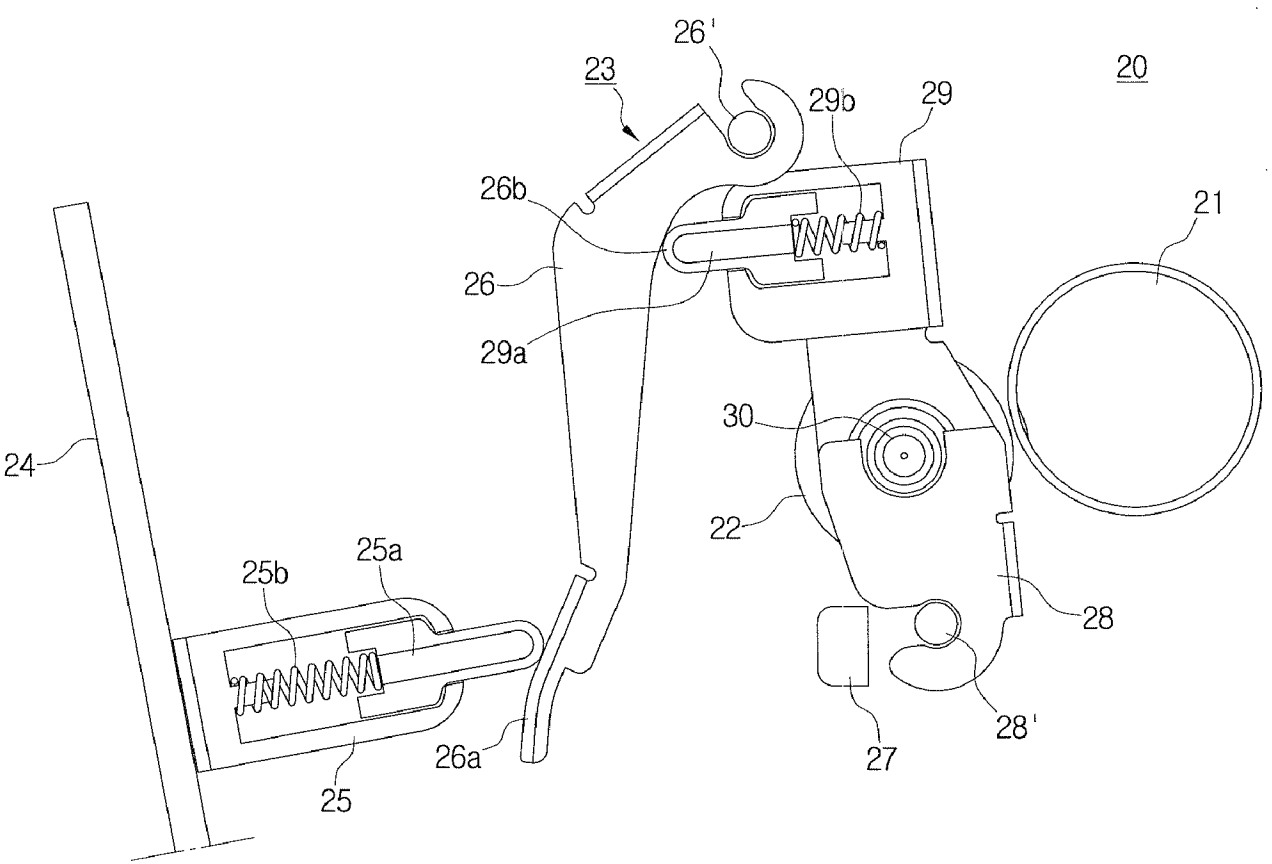
FIG. 3 shows a state of the pressure roller shown in FIG. 2 in which the pressure has been released.

FIG. 3 illustrates an embodiment in which the pressure of the pressure roller 22 is released. Referring to FIG. 3, when the cover 24 is opened, the pressure of the first pressured part 26*a* is released. Specifically, when the cover 24 is opened, the first member 26 rotates around the first rotational shaft 26' in the direction of the cover 24, so the first pressuring part 26*b* is released. When the first pressuring part 26*b* is released, while the pressure of the second pressure boss 29, which is the second pressured part, is released, the second member 28 rotates around the second revolving shaft in the direction of the cover 24 due to the elasticity of the heating roller 21 and the pressure roller 22. Thus, the pressure pressing the pressure roller 22 into contact with the heating roller 21 is removed.

Figure 4:
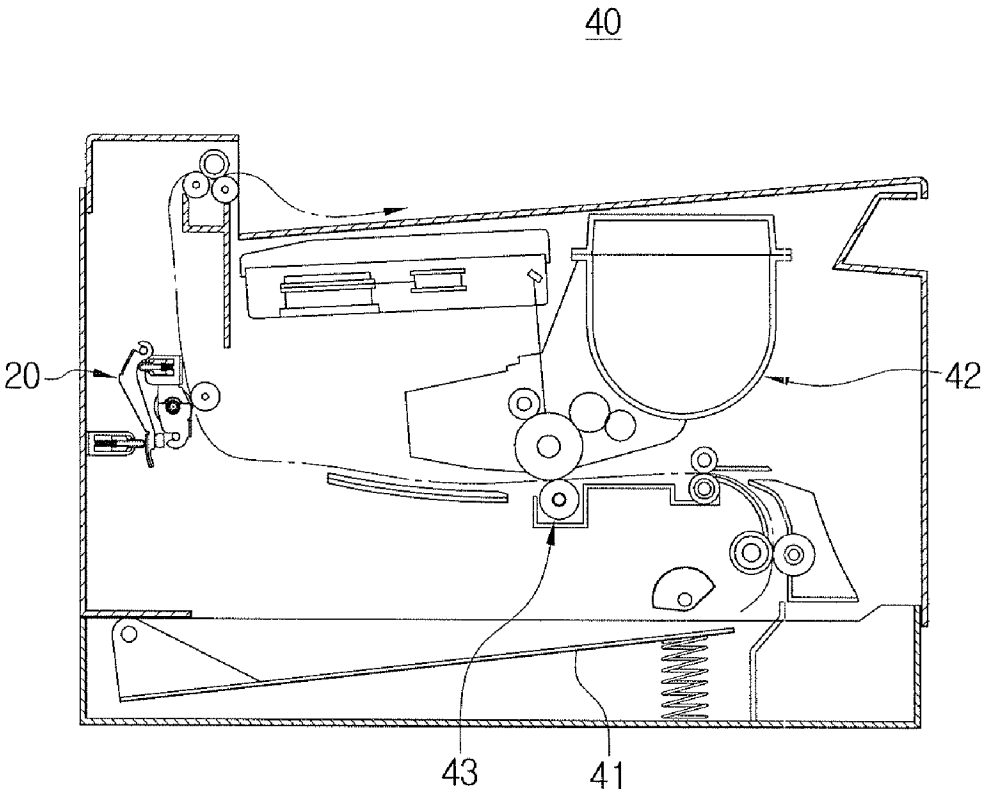
FIG. 4 shows an image forming apparatus having the fusing device shown in FIG. 2.

FIG. 4 illustrates an image forming apparatus including a fusing device according to aspects of the present invention. The image forming apparatus 40 of FIG. 4 includes a document feed device 41 which picks up the document from the paper tray and feeds the document along a predetermined feed path, a developing device 42 which applies developing materials to an electrostatic latent image and develops the image, a transfer device 43 which transfers the developed image onto the document, and a fusing apparatus 20, as described above. It is understood that the fusing device according to aspects of the present invention may be used with various types of image forming apparatuses other than the type shown in FIG. 4, including, for example, ink jet printers. Additionally, it is understood that the image forming apparatus is not required to have an S-type feed path, and may instead have other types of feed paths, such as a C-type feed path, as well as other components instead of or in addition to those components shown in FIG. 4 and described above.

The fusing device of the image forming apparatus according to aspects of the present invention provides a two-ended lever, so the user can open the cover of the image forming apparatus with little effort and release the pressure from the fusing device, and provides a fusing device of an image forming apparatus which adds pressure to the fusing device in a stable fashion when the cover is closed.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A fusing device of an image forming apparatus having a cover movable between an open position and a closed position, the cover having a first pressure boss, comprising:

a fusing unit having a heating roller and a pressure roller which contact each other and rotate together; and a pressure and release unit, comprising:

a first rotational shaft, a first member rotatable about the first rotational shaft and having a first pressuring part that transmits pressure in a direction of the heating roller when the cover is in the closed position and a first pressured part pressured by the cover in the closed position and disposed farther than the first pressuring part from the first rotational shaft, a second rotational shaft, and a second member rotatable about the second rotational shaft and having a second pressure boss pressured by the first pressuring part of the first member in the direction of the heating roller when the cover is in the closed position, wherein the second member supports a rotational shaft of the pressure roller to transmit the pressure received via the second pressure boss to the heating roller, wherein the first pressure boss of the cover transmits the pressure to the first pressured part when the cover is in the closed position.

2. The fusing device of claim 1, wherein the first pressure boss includes a first spring disposed inside of the first pressure boss and a sliding component attached to the spring which protrudes outside of the first pressure boss and contacts the first pressured part.

3. The fusing device of claim 1, wherein the second pressure boss is attached to the second pressuring part.

4. The fusing device of claim 3, wherein the second pressure boss comprises:

a second spring disposed inside of the second pressure boss; and a second sliding component attached to the second spring and which protrudes outside of the second pressure boss and is pressed by the first pressuring part.

5. The fusing device of claim 4, wherein a stiffness of the second spring is greater than a stiffness of a first spring included in the first pressure boss.

6. The fusing device of claim 1, further comprising a second pressuring part including a side of a recess in which a rotational shaft of the pressure roller is rotatably inserted and which presses the pressure roller in a direction of the heating roller when the cover is in the closed position.

7. The fusing device of claim 1, comprising a stopper to limit a rotation of the member to a predetermined internal range.

8. The fusing device of claim 1, wherein a ratio between a length from the rotational shaft to the pressuring part and a length from the rotational shaft to the pressured part is approximately 11:73.5.

9. The fusing device of claim 2, wherein a ratio between a length from the second rotational shaft to the second pressuring part and a length from the second rotational shaft to the second pressure boss is approximately 23:55.

10. An image forming apparatus comprising:

a document feed device which picks up a document from a feeding tray and feeds the document along a feed path;

a developing device which applies developing materials to an electrostatic latent image to develop the electrostatic latent image;

a transfer device which transfers the developing materials onto the document; and a cover movable between an open position and a closed position, the cover having a first pressure boss; and a fixing device having a heating roller and a pressure roller which contact each other and rotate together, the fixing device including a pressure and release unit, wherein the pressure and release unit comprises a first rotating shaft, and a first member rotatable about the first rotating shaft, the first member comprising:

a first pressuring part which transmits pressure in a direction of the heating roller when the cover is in the closed position; and a first pressured part disposed at a position farther than the first pressuring part from the first rotating shaft and which is pressured by the cover when the cover is in the closed position, a second rotational shaft, and a second member rotatable about the second rotational shaft and having a second pressure boss pressured by the first pressuring part of the first member in the direction of the heating roller when the cover is in the closed position, wherein the second member supports a rotational shaft of the pressure roller to transmit the pressure received via the second pressure boss to the heating roller, wherein the first pressure boss of the cover transmits the pressure to the first pressured part when the cover is in the closed position.

11. The image forming apparatus of claim 10, wherein the first pressure boss includes a first spring disposed inside of the first pressure boss and a sliding component attached to the spring which protrudes outside of the first pressure boss and contacts the first pressured part.

12. The image forming apparatus of claim 10, wherein the second pressure boss is attached to the second pressuring part.

13. The image forming apparatus of claim 12, wherein the second pressure boss comprises:

a second spring disposed inside of the second pressure boss; and a second sliding component attached to the second spring and which protrudes outside of the second pressure boss and is pressed by the first pressuring part.

14. The image forming apparatus of claim 13, wherein a stiffness of the second spring inside the second pressure boss is greater than a stiffness of a first spring inside the first pressure boss.

15. The image forming apparatus of claim 10, further comprising a second pressuring including a side of a recess in which a rotational shaft of the pressure roller is rotatably inserted and which presses the pressure roller in a direction of the heating roller when the cover is in the closed position.

16. The image forming apparatus of claim 10, comprising a stopper to limit a rotation of the member to a predetermined internal range.

17. The image forming apparatus of claim 10, wherein a ratio between a length from the rotational shaft to the pressuring part and a length from the rotational shaft to the pressured part is approximately 11:73.5.

18. The image forming apparatus of claim 11, wherein a ratio between a length from the second rotational shaft to the second pressuring part and a length from the second rotational shaft to the second pressure boss is approximately 23:55.

* * * * *

UNITED STATES PATENT AND TRADEMARK OFFICE

CERTIFICATE OF CORRECTION

PATENT NO. : 7,953,348 B2
APPLICATION NO. : 11/736194
DATED : May 31, 2011
INVENTOR(S) : Woong-Jae Chang et al.

It is certified that error appears in the above-identified patent and that said Letters Patent is hereby corrected as shown below:

Column 6, Line 21, In Claim 10, after “document;” delete “and”.

Column 7, Line 2, In Claim 15, after “pressuring” insert -- part --.

Signed and Sealed this
Twenty-eighth Day of February, 2012

David J. Kappos

David J. Kappos
*Director of the United States Patent and Trademark Office*